US008109583B2

(12) United States Patent
Bruestle

(10) Patent No.: US 8,109,583 B2
(45) Date of Patent: Feb. 7, 2012

(54) EJECTOR OF A MOVEABLE FURNITURE PART

(75) Inventor: Klaus Bruestle, Höchst (AT)

(73) Assignee: Julius Blum GmbH, Hochst (AT)

( * ) Notice: Subject to any disclaimer, the term of this patent is extended or adjusted under 35 U.S.C. 154(b) by 112 days.

(21) Appl. No.: 12/504,058

(22) Filed: Jul. 16, 2009

(65) Prior Publication Data

US 2009/0273262 A1 Nov. 5, 2009

Related U.S. Application Data

(63) Continuation of application No. PCT/AT2007/000563, filed on Dec. 11, 2007.

(30) Foreign Application Priority Data

Feb. 15, 2007 (AT) ..... A 239/2007
Apr. 13, 2007 (AT) ..... A 573/2007

(51) Int. Cl.
*A47B 95/02* (2006.01)

(52) U.S. Cl. ..... 312/319.2; 312/319.1; 312/319.6; 312/319.8

(58) Field of Classification Search .... 312/319.1–319.2, 312/319.5–319.8, 271, 273–274, 319.9
See application file for complete search history.

(56) References Cited

U.S. PATENT DOCUMENTS

| | | | | |
|---|---|---|---|---|
| 1,858,503 | A | 5/1932 | Hollman | |
| 2,689,776 | A * | 9/1954 | Cline | 312/319.9 |
| 3,005,672 | A * | 10/1961 | Becker | 312/319.7 |
| 3,854,785 | A * | 12/1974 | Manner et al. | 312/319.1 |
| 3,862,788 | A | 1/1975 | Hock et al. | |
| 4,720,154 | A | 1/1988 | Seiter | |
| 7,159,957 | B2 * | 1/2007 | Huber et al. | 312/331 |
| 2001/0008037 | A1 * | 7/2001 | Brustle | 16/71 |
| 2002/0046441 | A1 * | 4/2002 | Brustle | 16/254 |
| 2006/0061245 | A1 | 3/2006 | Huber et al. | |
| 2007/0103041 | A1 * | 5/2007 | Kropf et al. | 312/333 |
| 2007/0180654 | A1 | 8/2007 | Gasser | |
| 2008/0100189 | A1 | 5/2008 | Huber | |
| 2008/0191591 | A1 | 8/2008 | Blucher et al. | |
| 2009/0072687 | A1 * | 3/2009 | Fitz | 312/319.5 |

FOREIGN PATENT DOCUMENTS

AT 413 472 3/2006

(Continued)

OTHER PUBLICATIONS

Austrian Search Report issued Sep. 24, 2007 in connection with A 573/2007 corresponding to the present U.S. patent application.

International Search Report issued May 13, 2008 in the International (PCT) Application of which the present application is the U.S. National Stage.

*Primary Examiner* — Hanh V Tran

(74) *Attorney, Agent, or Firm* — Wenderoth, Lind & Ponack, L.L.P.

(57) ABSTRACT

A device for ejecting a movable furniture part from a closed end position in or on a furniture body, includes an ejector with a motor-driven ejector lever. A power transmission device interacting with the ejector lever is provided such that the force exerted on the movable furniture part by the ejector lever can be transferred in the mounted state of the device in a furniture body, in which the movable furniture part in the closed end position is at a distance from the ejector lever.

18 Claims, 18 Drawing Sheets

FOREIGN PATENT DOCUMENTS

| | | |
|---|---|---|
| DE | 20 2006 000 535 | 3/2006 |
| WO | 2004/100718 | 11/2004 |
| WO | 2006/029894 | 3/2006 |
| WO | 2006/113947 | 11/2006 |

* cited by examiner

EJECTOR OF A MOVEABLE FURNITURE PART

This application is a continuation application of International application PCT/AT2007/000563, filed Dec. 11, 2007, the entire disclosure of which is incorporated herein by reference.

BACKGROUND OF THE INVENTION

The present invention relates to a device for ejecting a movable furniture part from a closed end position in or on a furniture body, with an ejector having a motor-driven ejection lever.

In the past, devices of this type consisted substantially only of an ejector, the motor-driven ejection lever of which loosely abuts the movable furniture part in the closed end position thereof. Thus, devices of this type can be used only to a limited extent in conjunction with movable furniture parts mounted in or on the furniture body in such a way that the movable furniture part protrudes into the furniture body only to a very limited extent or not at all. Examples of furniture parts of this type include furniture doors and furniture flaps and also drawers which are much less deep than the furniture body.

The object of the invention is therefore to develop a device of this type in such a way as to broaden its area of use.

SUMMARY OF THE INVENTION

This object is achieved by a device having the features described below.

As a result of the provision of a force transmission means interacting with the ejection lever, the force exerted by the ejection lever during the ejection process can be transmitted to the movable furniture part, beyond the spacing between the movable furniture part and the ejection lever. The device is thus suitable for ejecting furniture doors and furniture flaps and also drawers which are much less deep than the furniture body.

Preferably, provision is made for the device to cause only ejection of the movable furniture part from the closed end position. Preferably, the force transmission means is therefore embodied in such a way that only the force exerted by the ejection lever in the direction of ejection (away from the furniture body, in the mounted state of the device) can be transmitted to the movable furniture part.

This measure may therefore be attained in that the force transmission means has a stop which the ejection lever loosely abuts in the closed end position of the movable furniture part.

Additionally or alternatively, provision may be made for the force transmission means to have a tappet which, in the closed end position of the movable furniture part, loosely abuts the movable furniture part.

In this connection, measures must be taken to move the tappet back again after completion of the ejection process. This may be attained in that the tappet is pre-stressed by a force storage means, preferably a spring, in the direction of the ejection lever (i.e. into the furniture body, in the mounted state of the device).

In order to ensure secure guidance of the tappet, provision may be made for the force transmission means to have a housing in which the tappet is guided in a channel.

A particularly simple design is obtained if provision is made for the stop to be fastened to or embodied on the tappet and to protrude, preferably substantially at right angles, from the tappet.

If force is to be transmitted by the ejection lever to the movable furniture part not only along a straight line, it is advantageous if provision is made for the tappet to be embodied sufficiently flexibly that it can be guided in a curved housing.

Preferably, the ejection lever of the ejector is embodied so as to be able to pivot to a limited degree. The lever moves during the ejection process from one end position of the pivoting movement to the other end position of the pivoting movement. The device according to the invention is very important above all when the ejector is arranged in the furniture body in such a way that the ejection lever remains set apart from the movable furniture part throughout the pivoting movement. Nevertheless, the invention may also be used in embodiments in which they ejector is arranged in the furniture body in such a way that it would abut the movable furniture part after covering a partial stretch of the overall stretch. In this case, the force transmission means can cause the entire pivoting movement of the ejection lever to be utilised for ejecting the movable furniture part.

Depending on the mass of the movable furniture part and depending on the extent of the ejection force, the movable furniture part may, after completing the ejection process, still be located in the region of action of an automatic retracting mechanism (for example having a self-closing function). In this case, provision should be made for a certain stop time during which a user can intervene in the gap formed between the furniture body and the movable furniture part, and can manually open the movable furniture part. Only once the waiting time has elapsed do the ejection lever and the force transmission means move back to their starting position.

In an advantageous embodiment of the invention, a preferably adjustable depth stop is provided for the force transmission means. Tolerances during fitting and in production can be compensated for via a depth stop of this type. This also ensures that, in the case of a touch latch operation, a sufficient triggering path is available at all times for the motor-driven ejection lever and that the front panels of the item of furniture close uniformly.

During the touch latch operation, provision is made for pressing-in of the movable furniture part by the user to be detected, in the closed end position thereof in or on the furniture body, by an open or closed-loop control means of the ejector. The pressing-in can be transmitted to the ejection lever via the force transmission device and detected by a measuring means (for example a rotary potentiometer) monitoring the position of the ejection lever. An ejector which operates in this manner is disclosed for example in Austrian patent AT 413 472 B (see in particular page 4, paragraphs 3 to 7; page 7, paragraphs 4 and 5; page 8, paragraph 6 and also the figures designated therein), so that there is no need at this point for a more detailed description.

In its simplest form, the depth stop comprises a spring buffer. In order to attain adjustability, provision may be made for the force transmission means to interact with the spring buffer via an adjustable stop element, preferably a set screw.

Protection is also sought for an item of furniture with a furniture body and a furniture part, in particular a furniture flap or furniture door, movably mounted in or on the furniture body, with a device according to one of the exemplary embodiments described hereinbefore.

In a preferred embodiment, provision is in this case made for at least one side wall of the furniture body to be embodied at least in certain portions as a honeycomb plate, and for the force transmission means to be arranged at least partly in the honeycomb plate.

In this case, the tappet of the force transmission device can penetrate the honeycomb plate without additional guidance. A certain guiding effect is obtained in any case as a result of the hole which is arranged in the front region of the honeycomb plate and out of which the tappet can issue from the side wall.

Protection is also sought for a force transmission device suitable for a device according to one of the preceding embodiments, having a stop and also a tappet which is connected to the stop and guided in a housing.

Preferably, provision is in this case made for the tappet to be able to be moved partly out of the housing counter to the force exerted by a force storage means, preferably a spring.

BRIEF DESCRIPTION OF THE DRAWINGS

Further advantages and details of the invention will emerge from the figures and also the description of the figures associated therewith. In the drawings.

DETAILED DESCRIPTION OF THE INVENTION

Figure 1A:
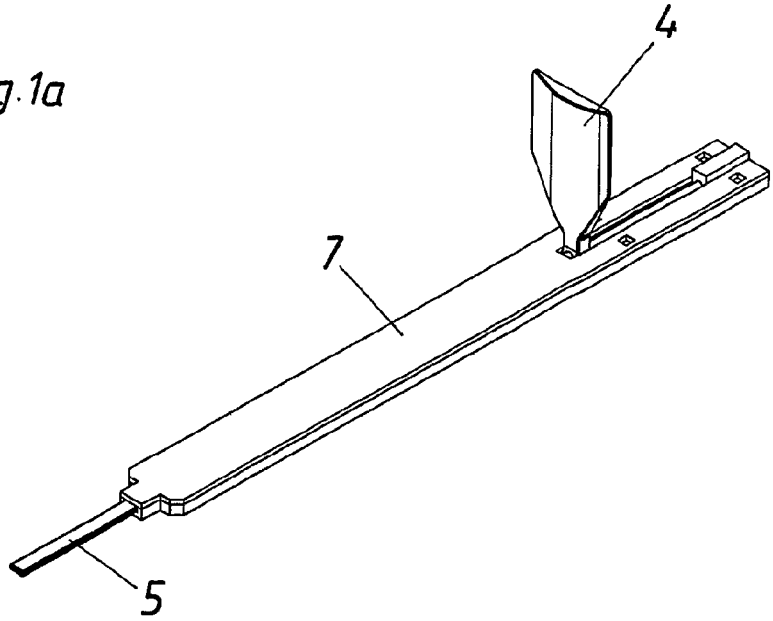
FIG. 1*a*, 1*b* are a perspective view and a detailed view of a force transmission means.
Figure 1B:
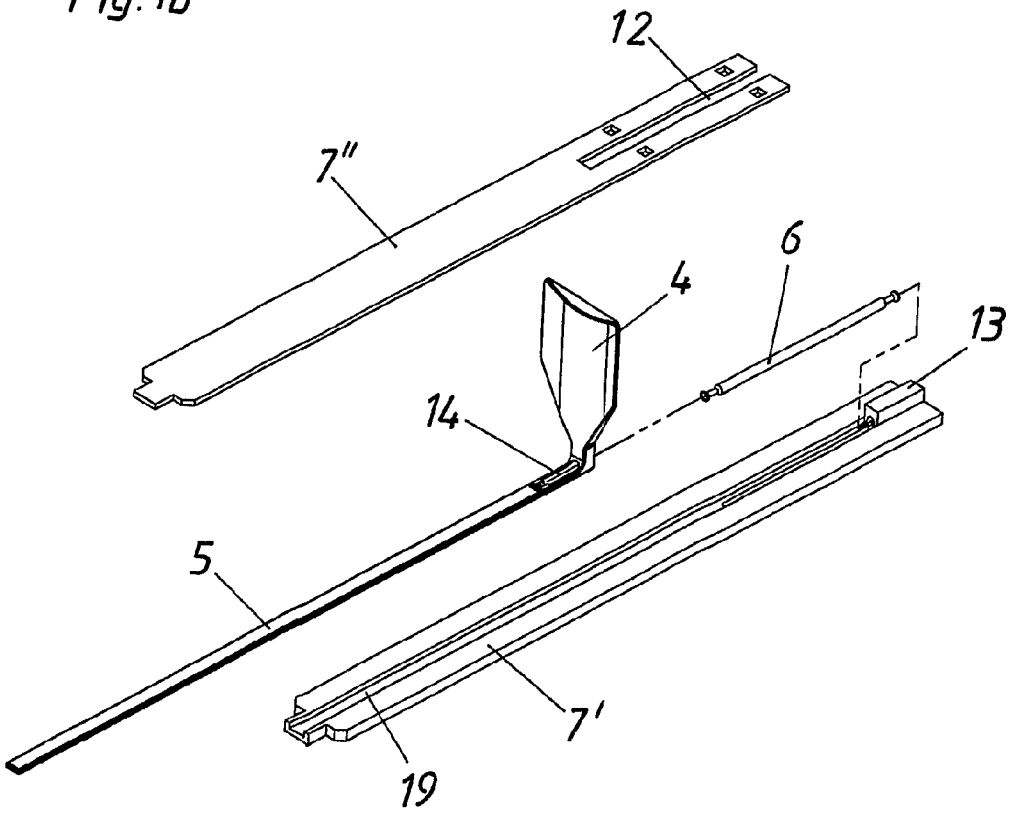

FIG. 1*a* shows the construction of an exemplary embodiment of a force transmission member. A housing 7 may be seen, in which a tappet 5 is guided in a channel 19. The tappet 5 can be moved partly out of the housing 7, and is in this exemplary embodiment integrally connected to a stop 4. The housing 7 is composed, as may be seen in particular in FIG. 1*b*, of a base plate 7' and a cover 7". The cover 7" has a slot 12 which allows the stop 4, which is arranged on the tappet 5, to move. Force is applied to the tappet 5 and thus the stop 4 by a force storage member 6 (in this case, a helical spring) in such a way that the force storage member 6 attempts to move the tappet 5 back into the housing 7. The force storage member 6 is on the one hand mounted on a bearing element 13 and on the other hand connected to the tappet 5. The tappet 5 has in this case at its trailing end a recess 14 for receiving an end of the force storage member 6.

Figure 2A:
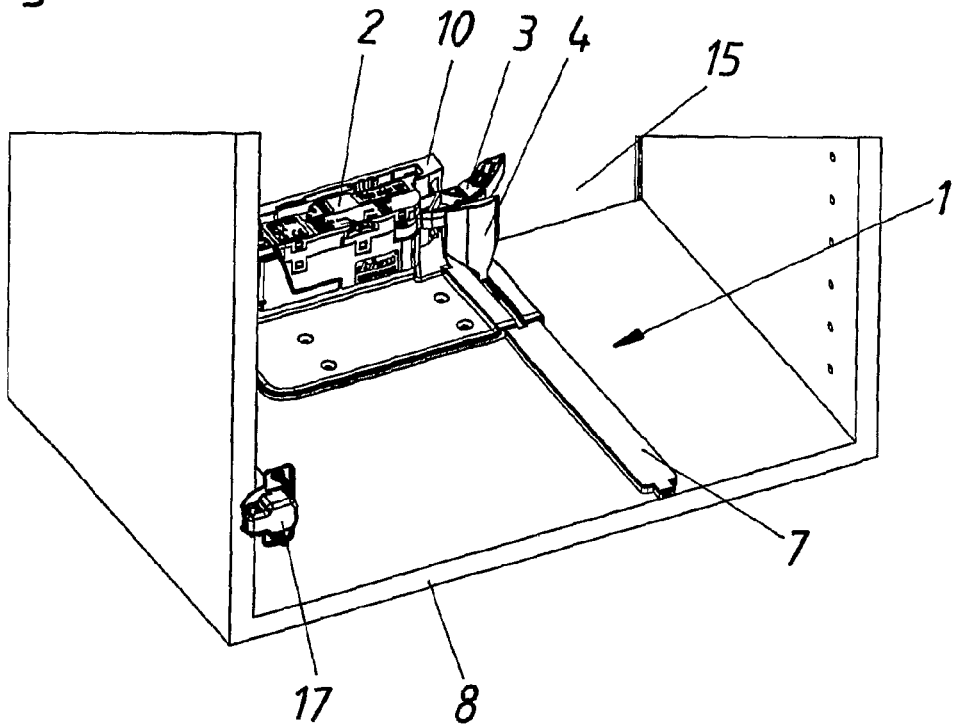
FIG. 2*a*, 2*b* are perspective partial views of a furniture body with a mounted device according to the invention in two different operating positions.

FIG. 2*a* shows the mobile body 8 of an item of furniture with the movable furniture part 9 removed. The arrangement of a device 1 according to the invention on a back wall 15 in the furniture body 8 may be seen. In the state illustrated in FIG. 2*a*, the movable furniture part 9 (only the hinges 17 are shown) would be located, in its closed end position, on the furniture body 8. As may be seen, the tappet 5 is located completely in the housing 7 and the stop 4 is in its backward (rear-most) position in which it abuts the ejection lever 3 of an ejector 2.

Figure 2B:
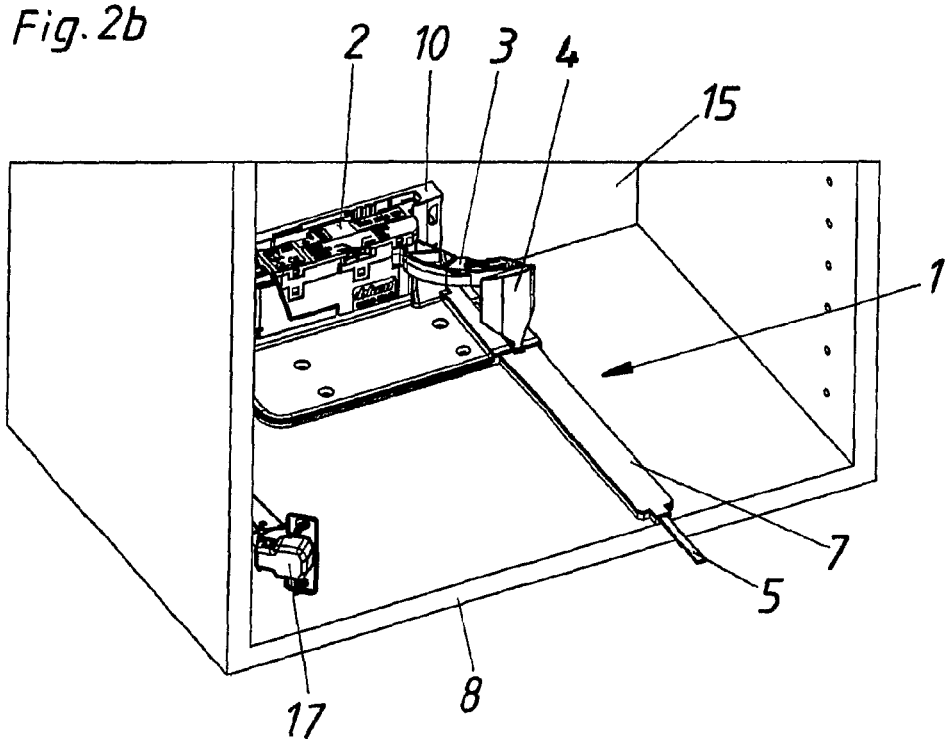

FIG. 2*b* shows the situation with the movable furniture part 9 (not shown in FIG. 2*b*) ejected. The tappet 5 has moved as far as possible out of the housing 7. This was caused by the interacting of the ejection lever 3 with the stop 4. As may be seen from FIGS. 2*a* and 2*b* viewed together, the ejection lever 3 is mounted so as to be able to pivot to a limited degree, the ejection movement taking place from the pivot position illustrated in FIG. 2*a* to the pivot position illustrated in FIG. 2*b*.

Figure 3:
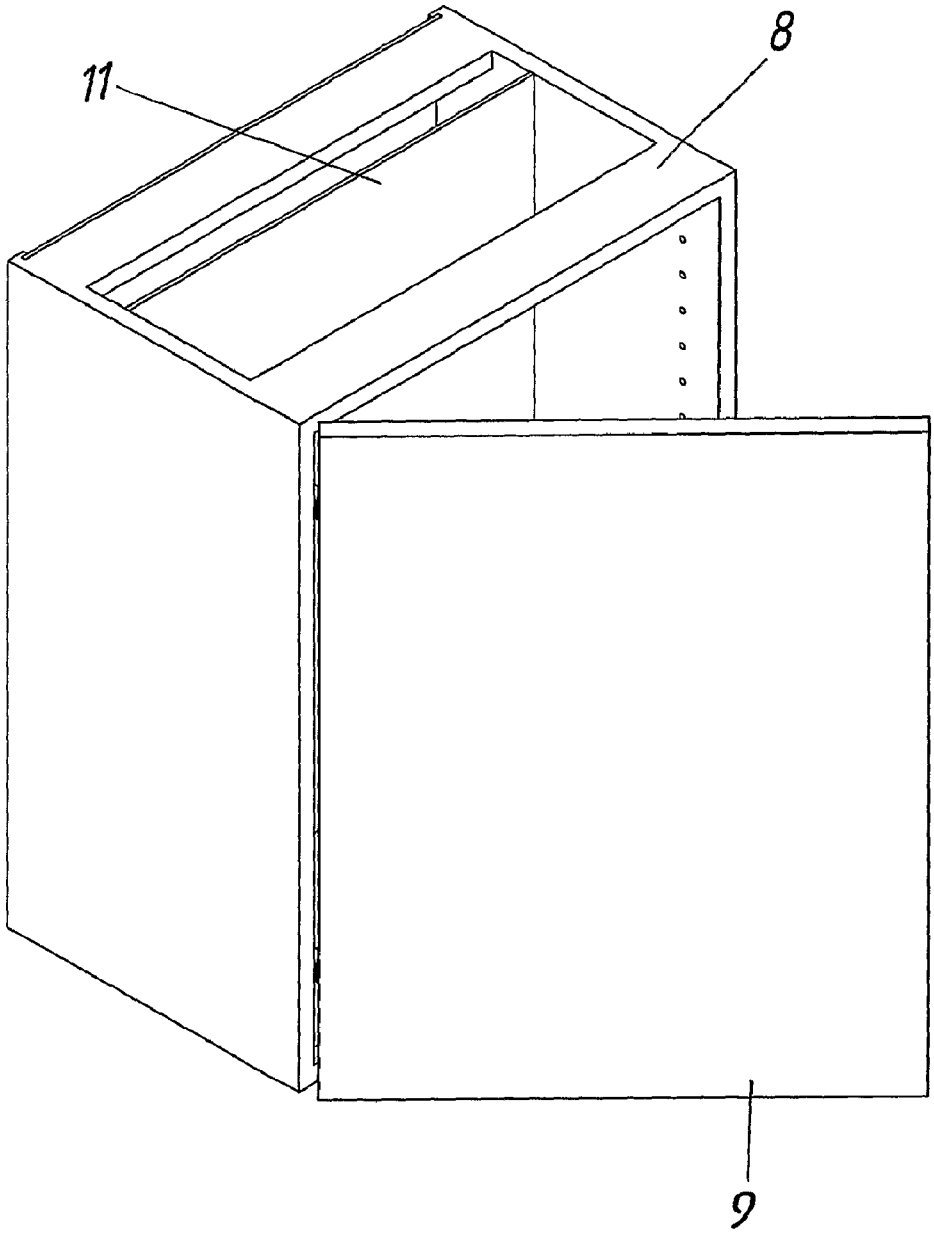
FIG. 3 is a perspective view of the item of furniture relating to FIGS. 2*a*, 2*b;*

FIG. 3 is a view of the item of furniture with the furniture body 8 and the movable furniture part 9 which is now illustrated (in this case, the movable furniture part 9 is embodied as a furniture door). The arrangement of the partition 11 in the furniture body 8, which partition serves as a screen for concealing the ejector 2 arranged behind it, may in particular also be seen. This partition 11 was not shown in FIGS. 2*a* and 2*b*.

Figure 4:
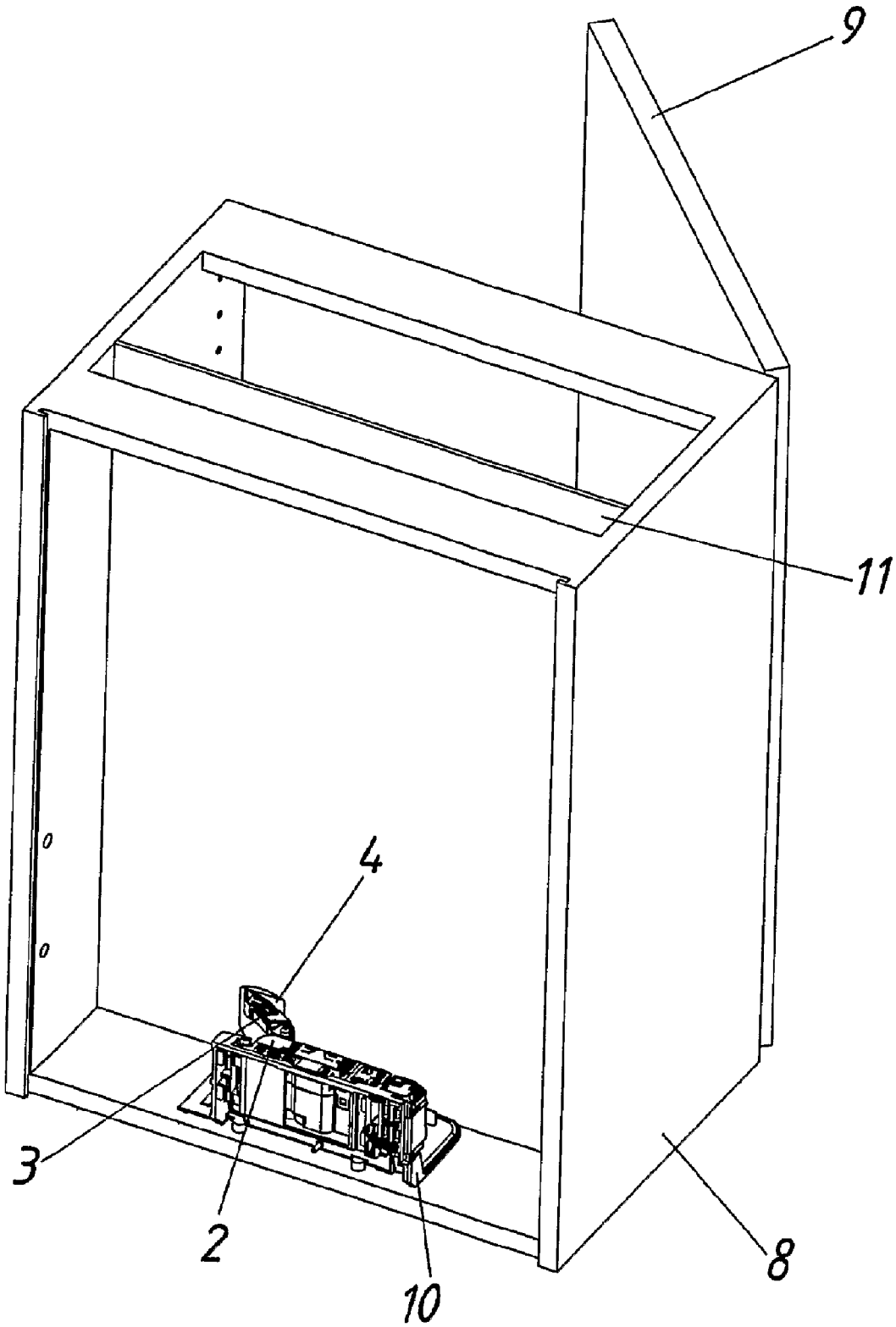
FIG. 4 is a rear view of the item of furniture illustrated in FIG. 3.

FIG. 4 is the rear view relating to FIG. 3, wherein the arrangement of the ejector 2 behind the partition 11 may be seen with the rear wall 15 removed. The partition 11 has of course a recess through which the housing 7 can pass.

Figure 5A:
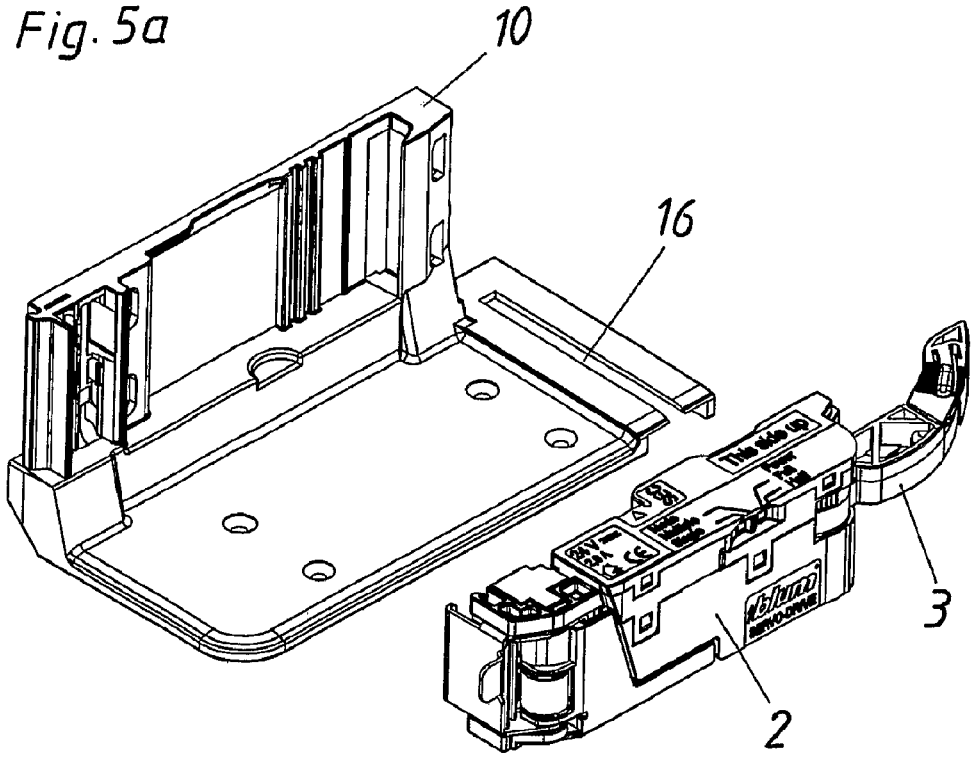
FIG. 5*a*, 5*b* are perspective views of an ejector prior to and after mounting to a support.
Figure 5B:
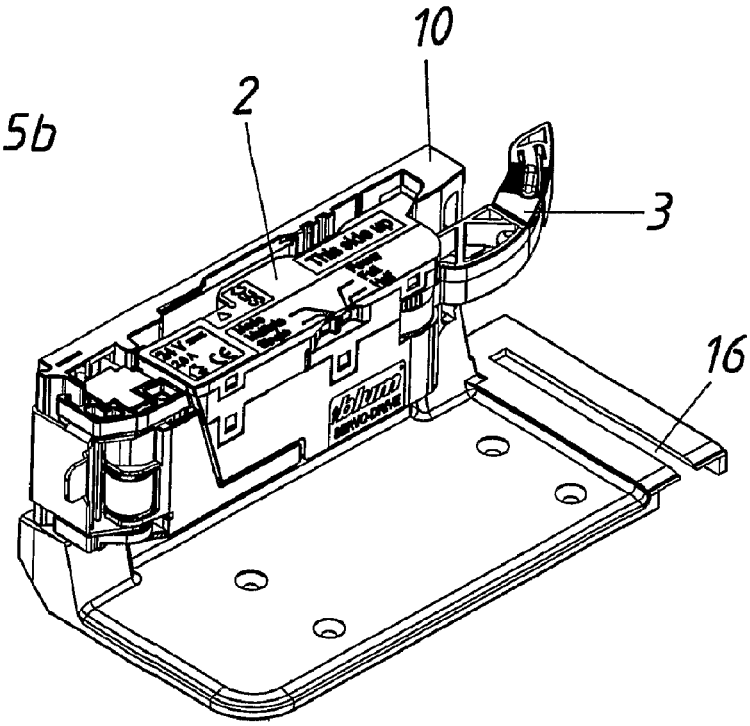

FIGS. 5*a* and 5*b* show the manner in which the ejector 2 is fastened to a support 10 which has at its side a socket 16 for the force transmission means.

Figure 6A:
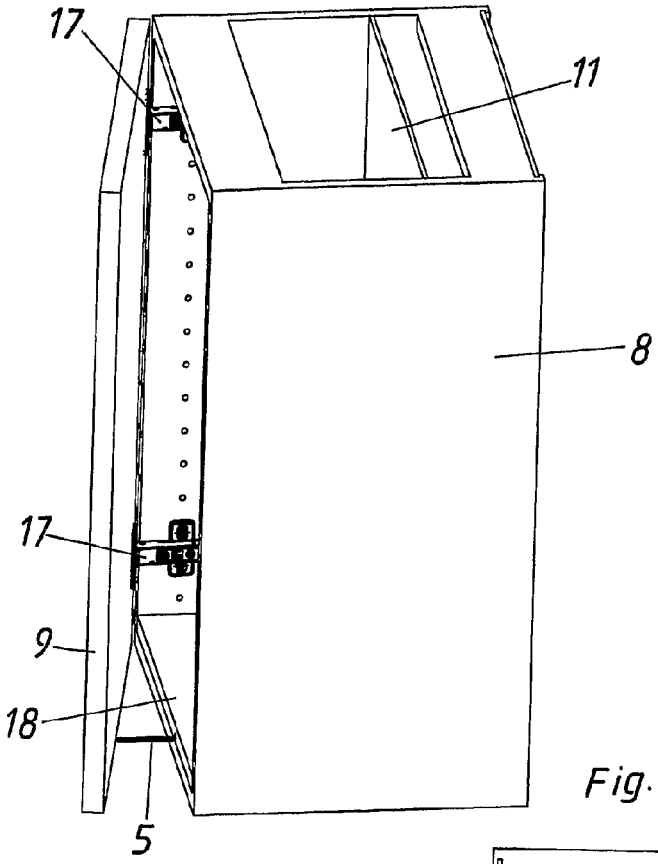
FIGS. 6*a* to 6*c* are a perspective view of an item of furniture, a view from above with the furniture body partly detached and a detailed view relating thereto, the item of furniture having a device according to the invention.
Figure 6B:
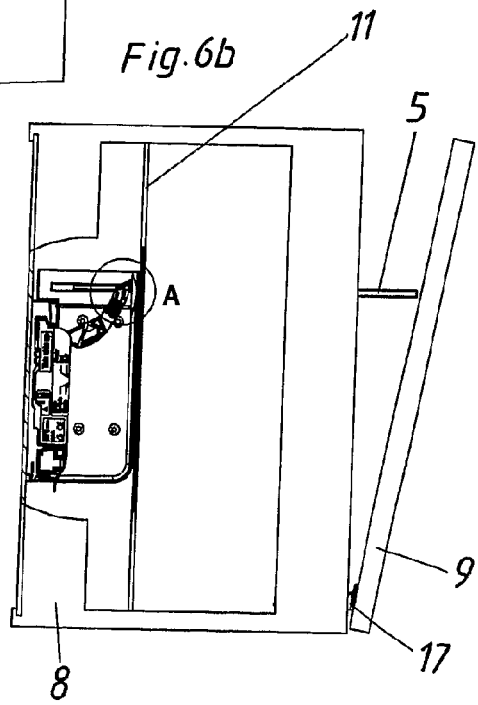
Figure 6C:
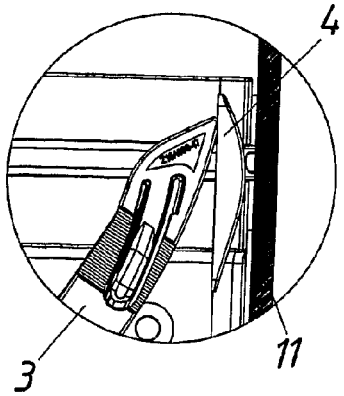

FIG. 6*a* shows the item of furniture once the movable furniture part 9 has been completely ejected. The movable furniture part 9 has in this case been opened through approx. 10° (corresponding to opening beyond the self-closing region of the hinges 17). Once the tappet 5 has been withdrawn into the housing 7, the movable furniture part 9 would therefore remain in this position until it is either opened or closed by a user. In other words, the tappet 5 is not connected to, and therefore only loosely abuts, the movable furniture part 9. FIG. 6*a* also shows that the furniture body 8 is provided in the base region with a covering base 18 which serves to conceal the housing 7 of the force transmission member. In order to make the device 1 clearer, this covering base 18 was not illustrated in the preceding figures.

Figure 7:
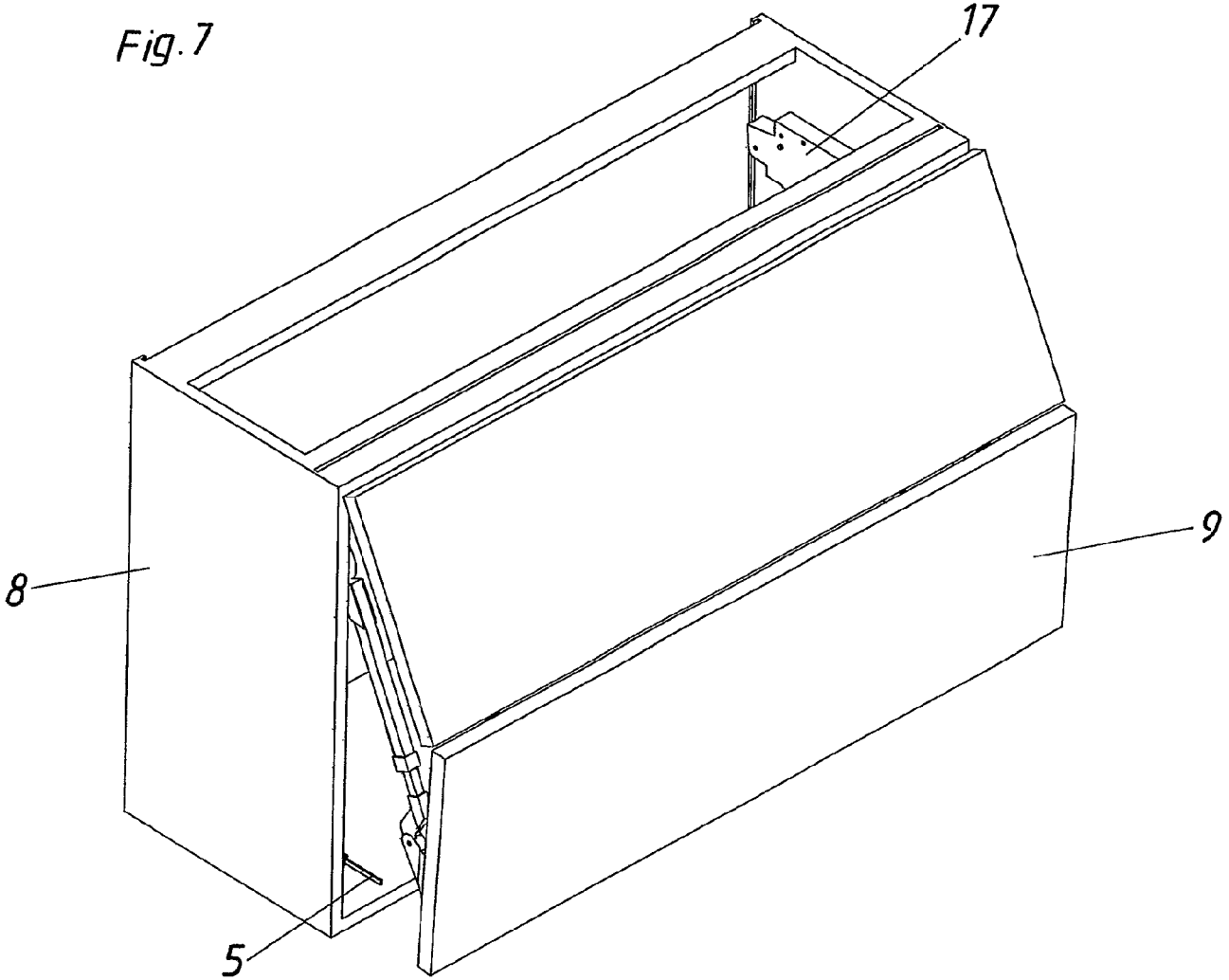
FIG. 7 is a perspective view of a further item of furniture with the device according to the invention.

FIG. 7 shows a further item of furniture with a furniture body 8 and a movable furniture part 9 which in this exemplary embodiment is embodied as a fold-up flap. The movable furniture part 9 has in this case, in the position illustrated in FIG. 7, already been moved further away from the furniture body 8 by a user. The tappet 5 has not yet been moved back into the housing 7. In this exemplary embodiment, the device 1 does not push the movable furniture part 9 beyond the self-closing region of the hinges 17. A certain waiting time is therefore provided before the tappet 5 is moved back into the housing 7.

Figure 8:
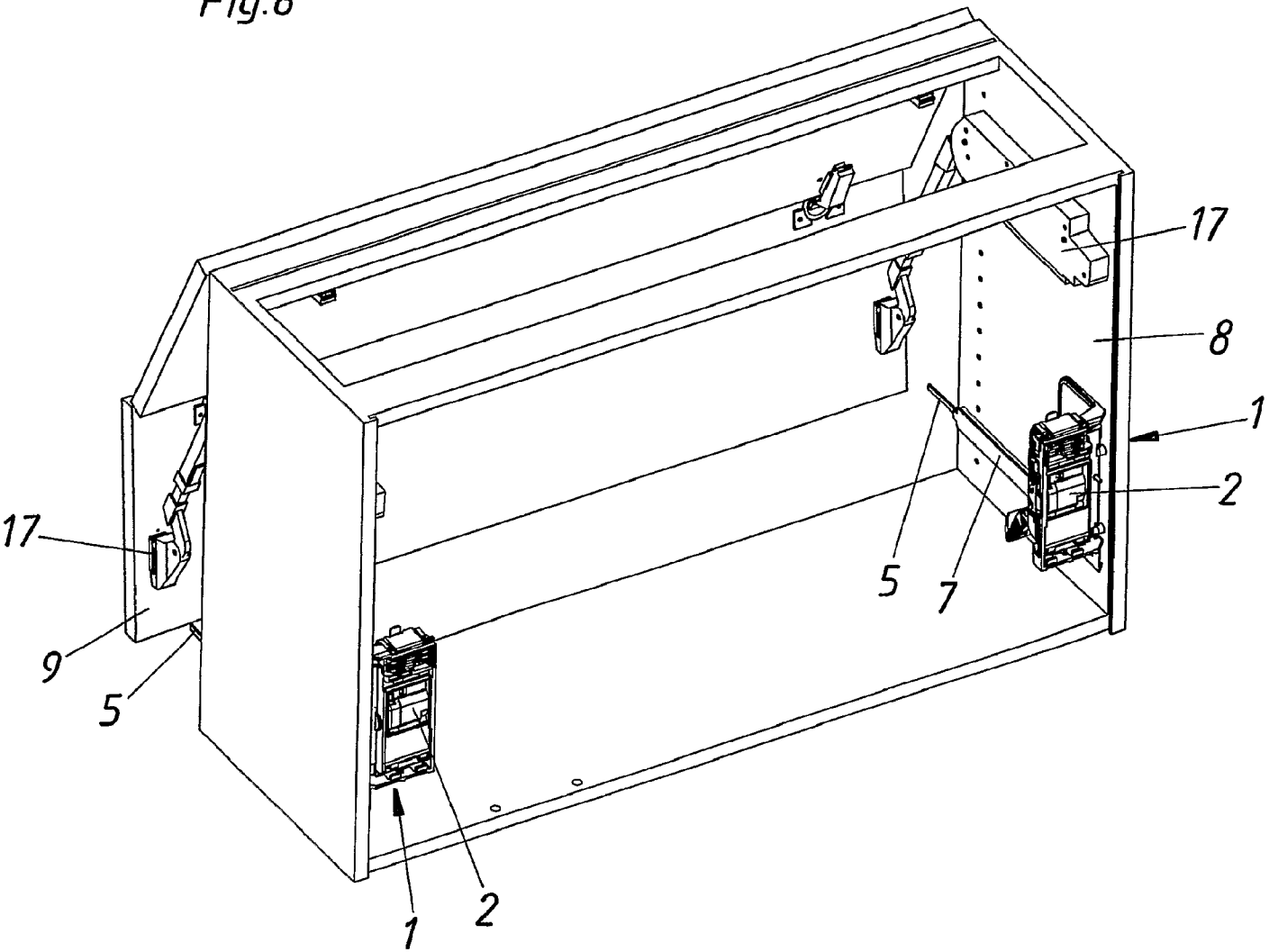
FIG. 8 is a rear view of the item of furniture illustrated in FIG. 7.

FIG. 8 shows that two devices 1 according to the invention, which are mounted on both sides on the furniture body 8, are provided in this exemplary embodiment.

Figure 9:
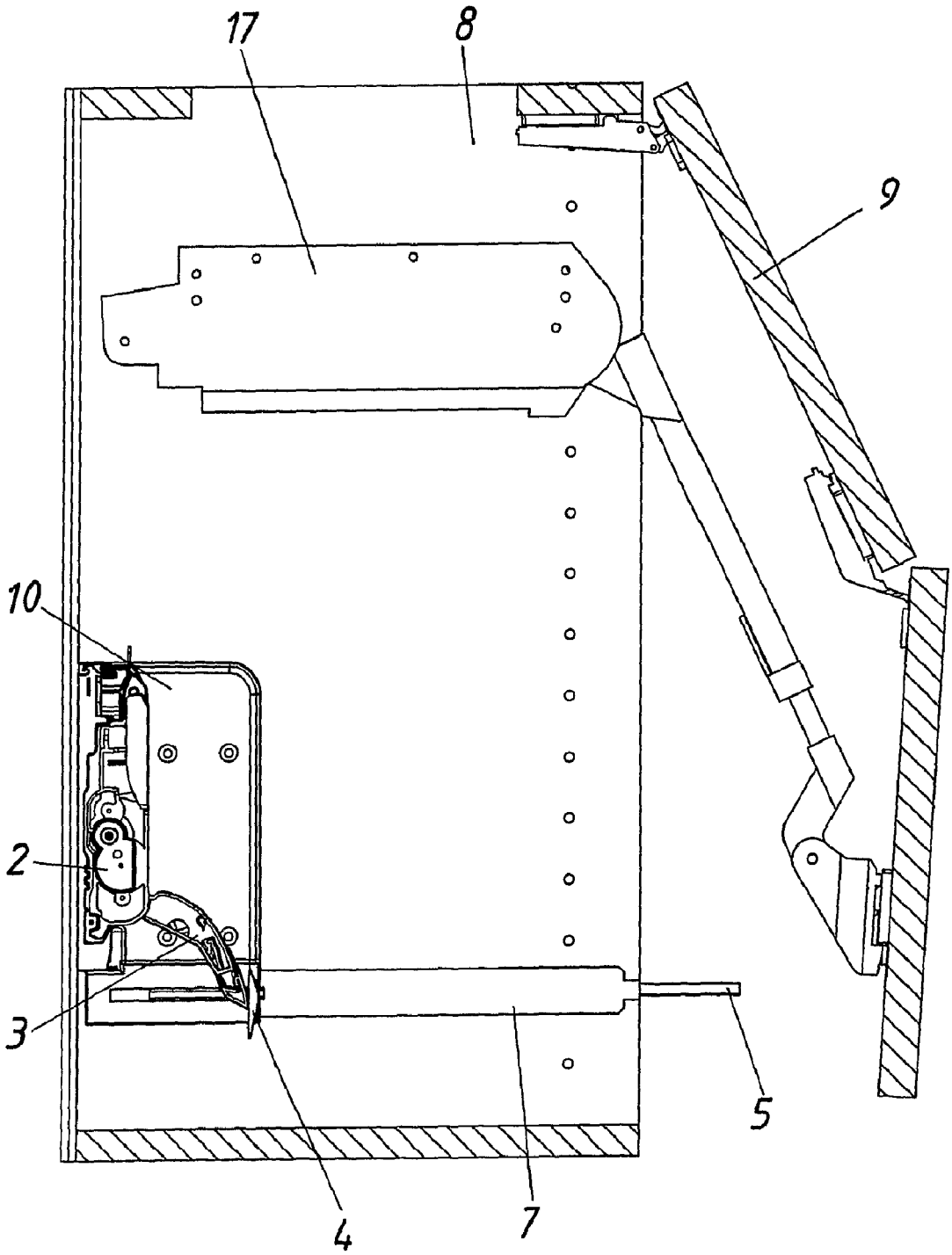
FIG. 9 is a sectional illustration relating to FIGS. 7 and 8.

FIG. 9 shows a situation corresponding to FIGS. 7 and 8. The ejection lever 3 of the ejector 2 is therefore pivoted as far as possible and has displaced the stop 4 of the force transmission member as far as possible. As a result, the tappet 5 has been moved as far as possible out of the housing 7. The movable furniture part 9 has been opened further by a user.

Figure 10E:
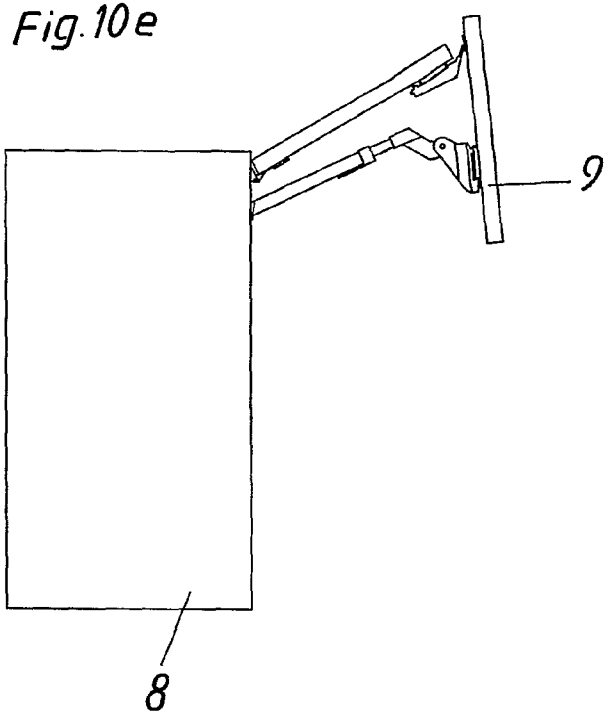
FIGS. 10*a* to 10*e* show an exemplary operating sequence, in the item of furniture illustrated in FIGS. 7 to 9.
Figure 10C:
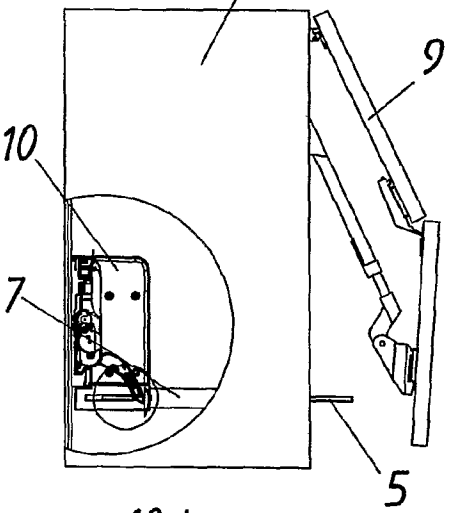
Figure 10D:
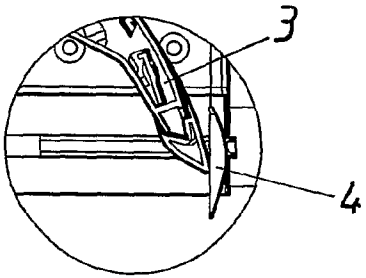
Figure 10A:
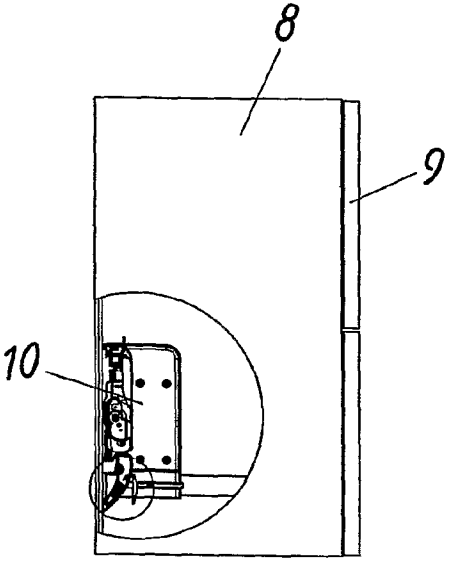
Figure 10B:
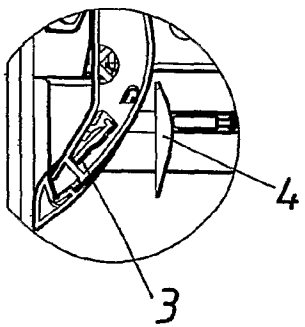

FIGS. 10*a* to 10*e* show by way of example a complete sequence of movement on the item of furniture illustrated in FIGS. 7 to 9. FIG. 10*b*, in particular, shows that in this exemplary embodiment, the ejection lever 3 of the ejector 2 does not yet abut, in the closed end position of the movable furniture part 9, the stop 4 of the force transmission means. FIG. 10*d* does show the ejection lever 3 abutting the stop 4 after the ejection lever 3 has sufficiently pivoted into position. Thus, it is clear that ejection lever 3 is not permanently connected to, and therefore only loosely abuts, stop 4.

FIG. 10*e* shows the movable furniture part 9 in its completely opened end position.

Figure 11A:
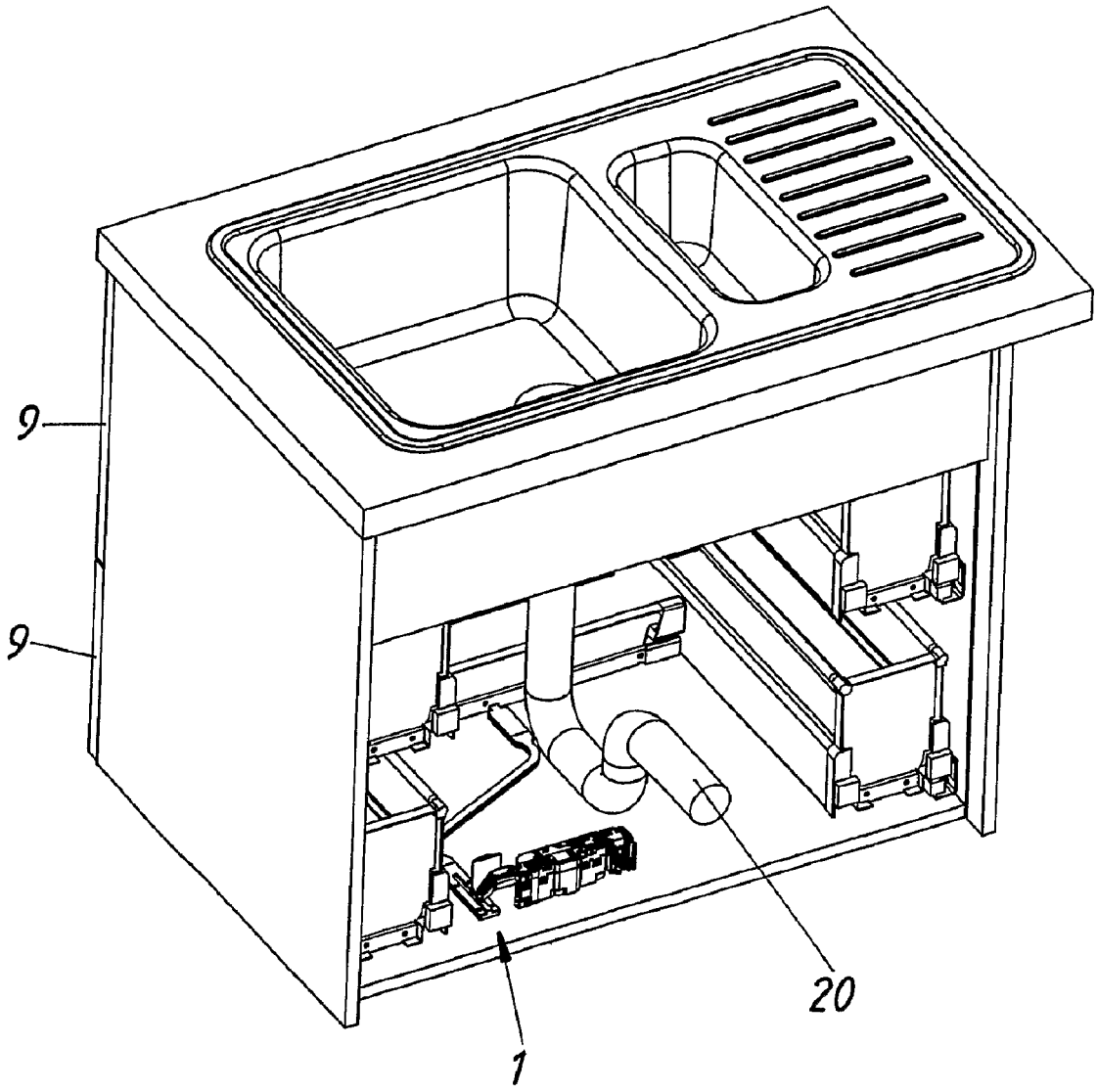
FIG. 11*a*, 11*b* are perspective partial views of a furniture body with a mounted device according to the invention.

FIG. 11*a* shows a furniture body 8 which is embodied as a sink unit and in which two furniture parts 9, embodied as drawers, are movably mounted. A device 1 according to the invention is provided in relation to the lower movable furniture part 9 (see FIG. 11*b*).

Figure 11B:
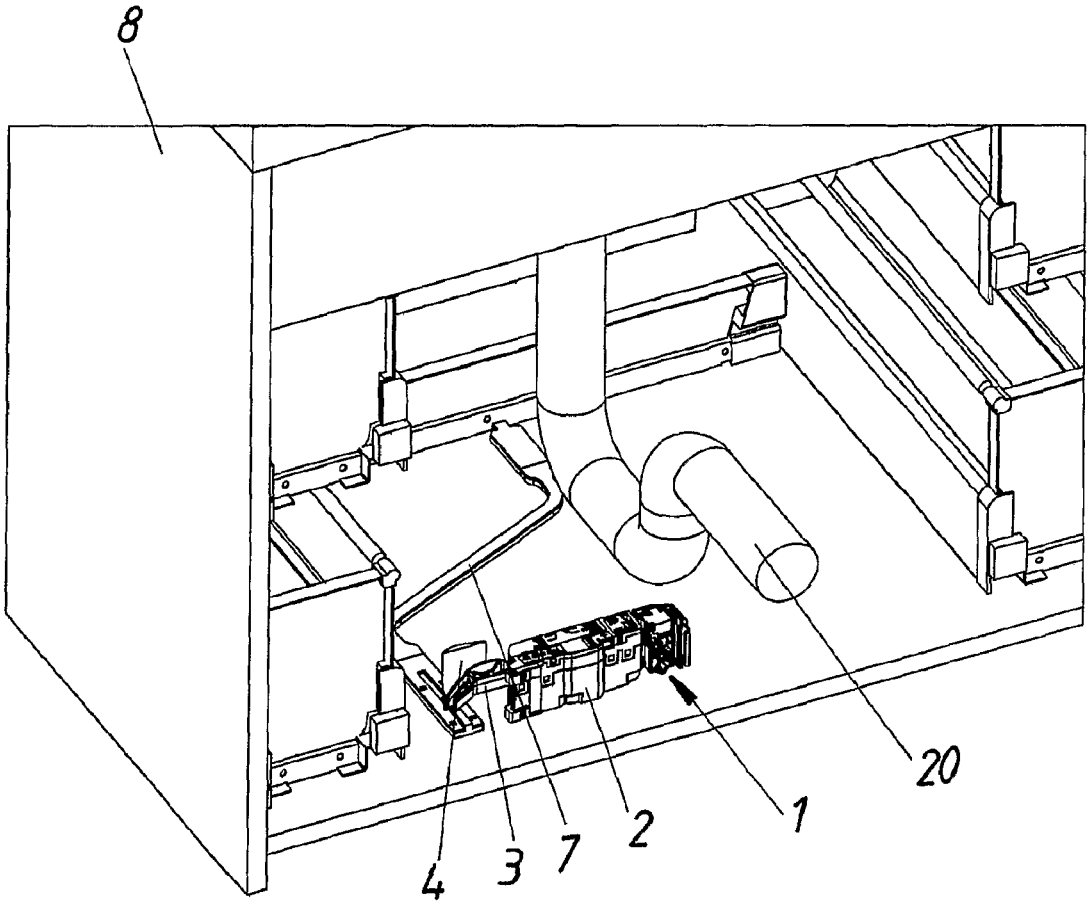

FIG. 11*b* shows that force is transmitted by the ejection lever 3 to the movable furniture part 9 in this exemplary embodiment not along a straight line, but in a laterally offset (non-linear) manner. Thus, the device 1 can be mounted laterally of the pipe 20 and nevertheless centrally apply the ejection force to the movable furniture part 9. For this purpose, the tappet 5 (which may not be seen in FIG. 11*a* and 11*b*) is embodied sufficiently flexibly so that it can be guided in the housing 7 which is embodied in a partially curved manner.

FIGS. 12*a* to 12*e* show a furniture body 8 with side walls embodied in certain portions as honeycomb plates 21 (only one side wall is shown). In this exemplary embodiment, the ejector 2 and also a large part of the force transmission member are arranged behind a partition 11. The tappet 5 for transmitting force from the ejection lever 3 to the movable furniture part 9 is in this exemplary embodiment arranged in a recess in the side wall or in the portion embodied as the honeycomb plate 21 in the side wall itself. In this case, it is not necessary to guide the tappet 5 over its entire length. Guidance is provided merely through the housing 7 in proximity to the ejector 2 itself and is also attained through the hole which is arranged in the front region of the honeycomb plate 21 and through which the tappet 5 issues from the side wall.

Figure 12A:
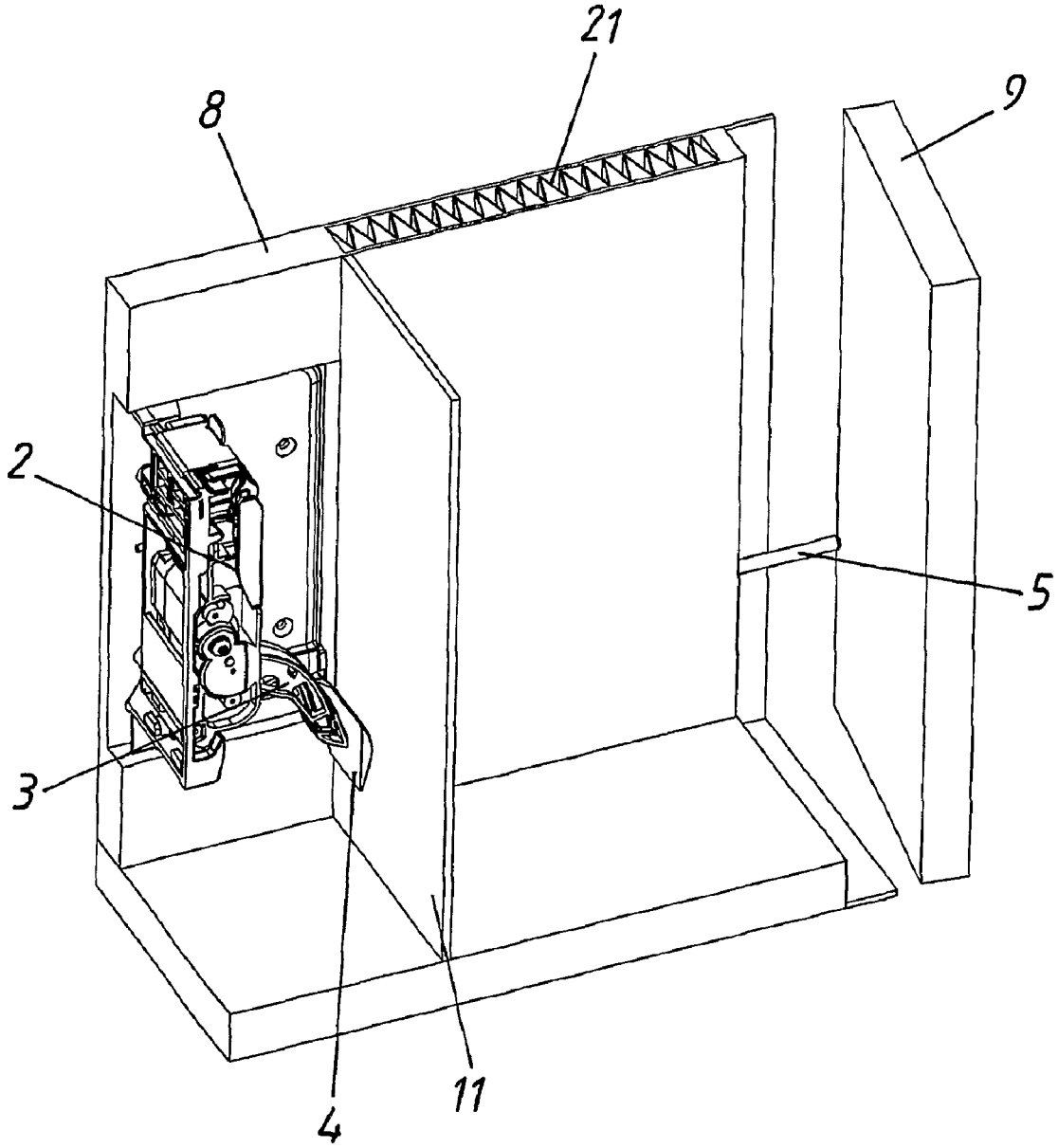
FIGS. 12*a* to 12*e* are perspective partial views of a furniture body with a mounted device according to the invention in accordance with a further embodiment.
Figure 12B:
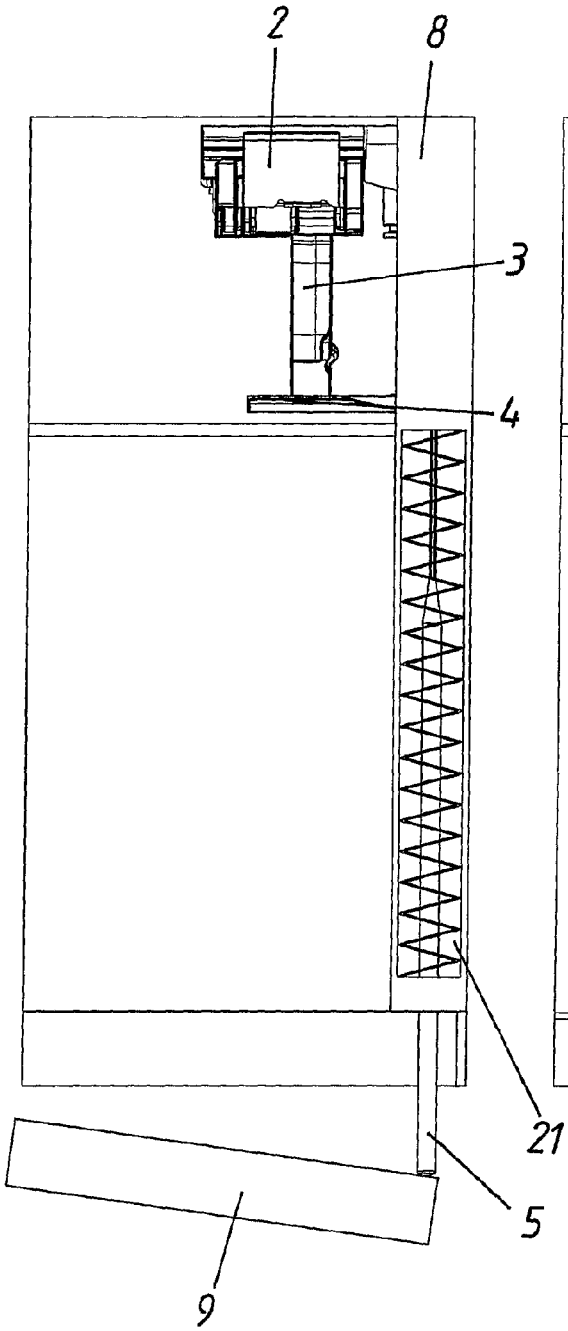
Figure 12C:
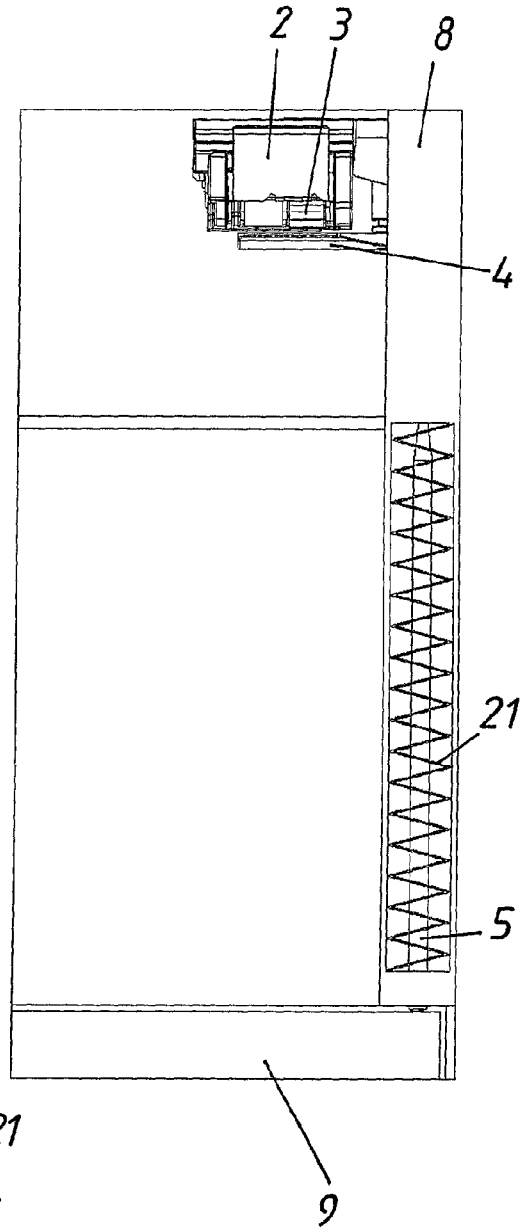
Figure 12D:
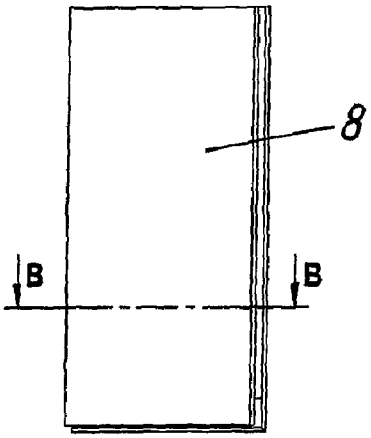
Figure 12E:
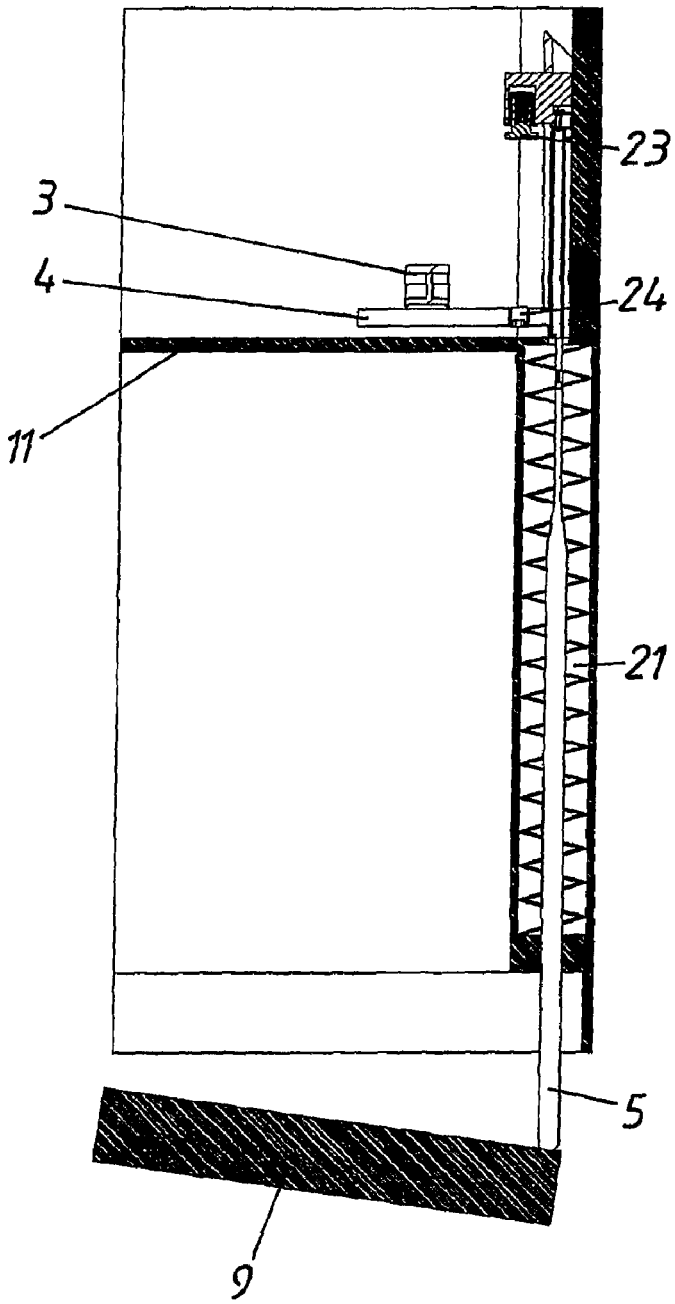
Figure 13A:
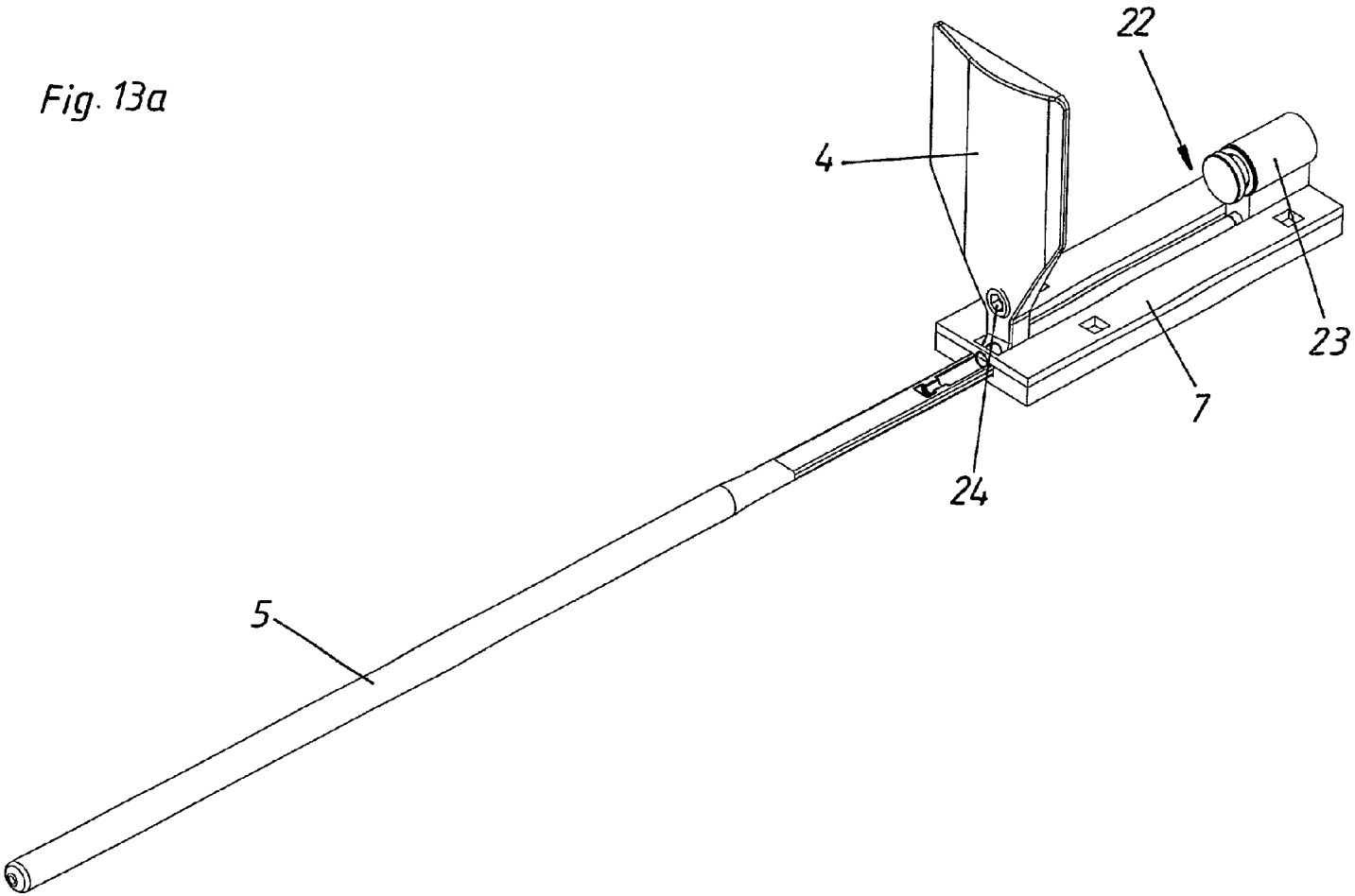
FIGS. 13*a* to 13*d* are various views of a further exemplary embodiment of the device according to the invention.
Figure 13B:
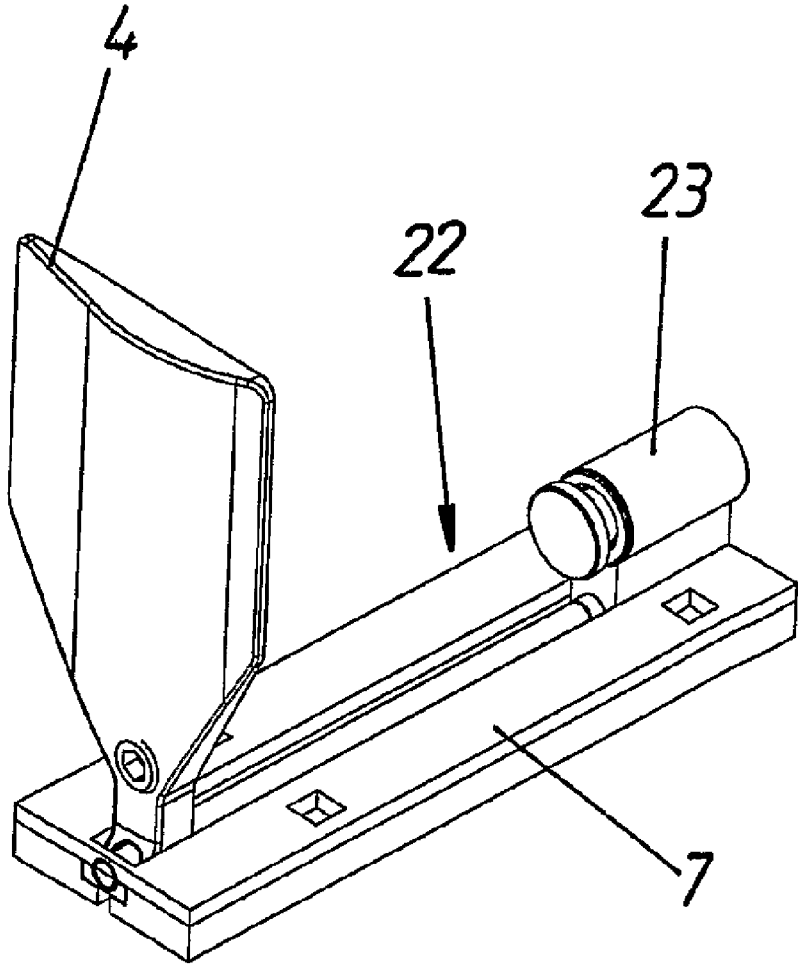
Figure 13C:
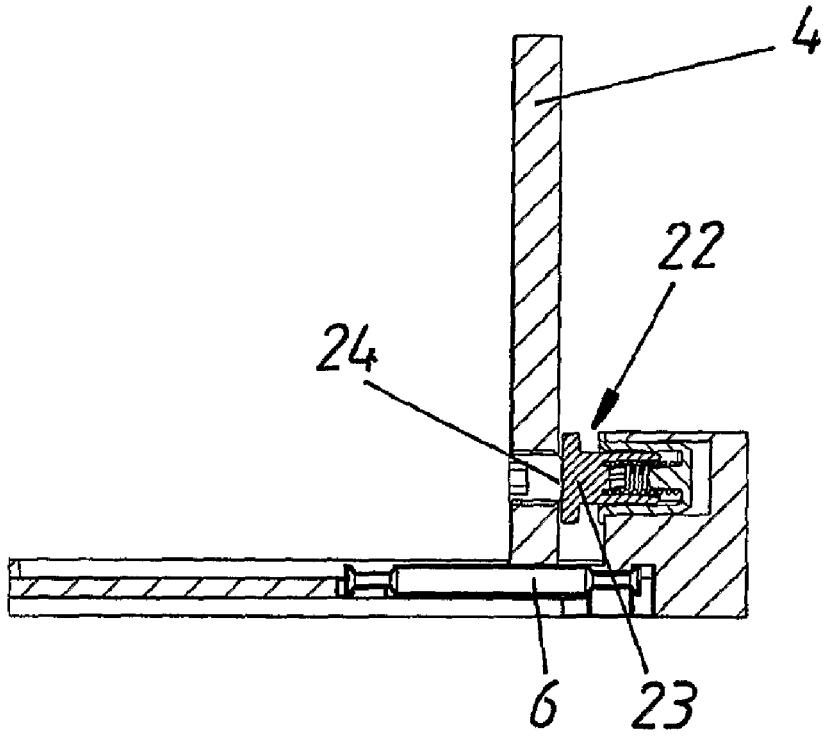
Figure 13D:
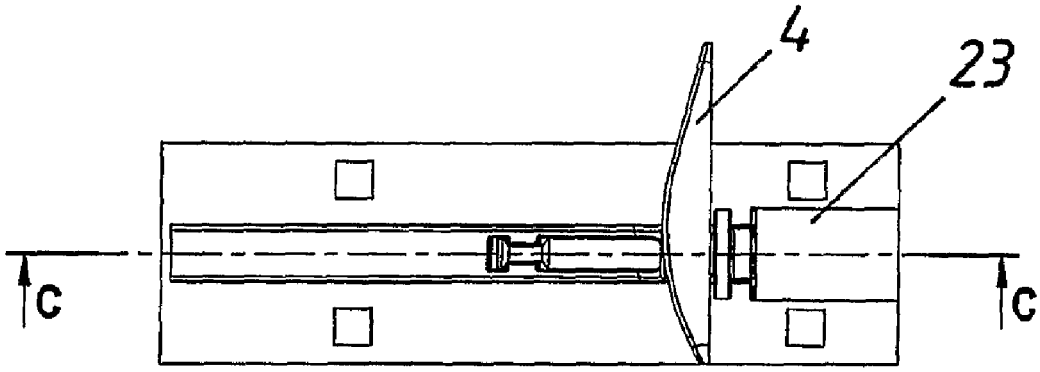

A depth stop 22 for the force transmission member may be seen in FIG. 12*e* and is illustrated in detail in FIGS. 13*a* to 13*d*, which depth stop has in this exemplary embodiment a spring buffer 23 (arranged on the part of the housing 7 that is stationary relative to the stop 4) and an adjustable stop element 24 (in this case, a set screw) arranged on the stop 4. In this exemplary embodiment, the overhang of the adjustable stop element 24 may be altered by an edge key. This allows the stop depth to be set.

Although the figures show merely an embodiment of a movable furniture part 9 as a furniture door, fold-up flap or drawer, it would also be conceivable to use the device according to the invention during upward pivoting or upward folding.

The ejectors 2 illustrated in the figures are triggered by sensing elements (not shown in the figures) arranged on the furniture body 8 or on the movable furniture part 9. Other measures with which a person skilled in the art is familiar, such as electrical supply lines and the like, have not been shown either.

The invention claimed is:

1. An ejecting device for ejecting a movable furniture part from a closed end position, said ejecting device comprising:

an ejector having a motor-driven ejection lever to be spaced apart from the movable furniture part; and a force transmission member for transmitting only an opening force from said ejection lever of said ejector to the movable furniture part, said force transmission member including a stop disconnected from said ejection lever, said stop being configured to loosely abut said ejection lever during transmission of the opening force from said ejection lever such that the opening force is applied from said ejection lever to said stop and from said stop to the movable furniture part so as to move said force transmission member and the movable furniture part in an opening direction;

wherein said force transmission member further includes a tappet configured to loosely abut the movable furniture part during transmission of the opening force from said ejection lever such that the opening force is applied from said ejection lever to said stop, from said stop to said tappet, and from said tappet to the movable furniture part so as to move said tappet and the movable furniture part in the opening direction.

2. The ejecting device of claim 1, further comprising a force storage member for biasing said tappet in a direction toward said ejection lever.

3. The ejecting device of claim 2, wherein said force storage member comprises a spring.

4. The ejecting device of claim 1, wherein said force transmission member further includes a housing having a channel formed therein, said tappet being guided in said channel.

5. The ejecting device of claim 1, wherein said stop is attached to said tappet and protrudes orthogonally from said tappet.

6. The ejecting device of claim 1, wherein said force transmission member further includes a curved housing, said tappet being flexible so as to be guided in said curved housing.

7. The ejecting device of claim 1, wherein said tappet is non-linear so as to transmit the opening force from said ejection lever in a laterally offset manner.

8. The ejecting device of claim 1, wherein said stop comprises an adjustable depth stop.

9. The ejecting device of claim 8, wherein said depth stop comprises a spring buffer.

10. The ejecting device of claim 9, wherein said force transmission member interacts with said spring buffer via an adjustable stop element.

11. A furniture component comprising:

a furniture body;

a movable furniture part movable relative to said furniture body; and an ejecting device for ejecting said movable furniture part from a closed end position against said furniture body, said ejecting device including:

an ejector having a motor-driven ejection lever spaced apart from said movable furniture part; and a force transmission member for transmitting only an opening force from said ejection lever of said ejector to said movable furniture part, said force transmission member including a stop disconnected from said ejection lever, said stop being configured to loosely abut said ejection lever during transmission of the opening force from said ejection lever such that the opening force is applied from said ejection lever to said stop and from said stop to said movable furniture part so as to move said force transmission member and said movable furniture part in an opening direction;

wherein said force transmission member further includes a tappet configured to loosely abut said movable furniture part during transmission of the opening force from said ejection lever such that the opening force is applied from said ejection lever to said stop, from said stop to said tappet, and from said tappet to said movable furniture part so as to move said tappet and said movable furniture part in the opening direction.

12. The furniture component of claim 11, wherein at least a portion of a side wall of said furniture body comprises a honeycomb plate, said force transmission member being arranged at least partly within said honeycomb plate.

13. The furniture component of claim 11, further comprising a force storage member for biasing said tappet in a direction toward said ejection lever.

14. The furniture component of claim 13, wherein said force storage member comprises a spring.

15. The furniture component of claim 11, wherein said force transmission member further includes a housing having a channel formed therein, said tappet being guided in said channel.

16. The furniture component of claim 11, wherein said stop is attached to said tappet and protrudes orthogonally from said tappet.

17. The furniture component of claim 11, wherein said force transmission member further includes a curved housing, said tappet being flexible so as to be guided in said curved housing.

18. The furniture component of claim 11, wherein said tappet is non-linear so as to transmit the opening force from said ejection lever in a laterally offset manner.

* * * * *